United States Patent [19]

Rahill

[11] Patent Number: 4,955,548

[45] Date of Patent: Sep. 11, 1990

[54] METHOD AND APPARATUS FOR COMMINUTING CREMATION REMAINS

[75] Inventor: Paul F. Rahill, Longwood, Fla.

[73] Assignee: Industrial Equipment & Engineering Company, Orlando, Fla.

[21] Appl. No.: 421,524

[22] Filed: Oct. 13, 1989

[51] Int. Cl.[5] ..... B02C 13/26

[52] U.S. Cl. ..... 241/30; 241/199.12; 241/282.1; 241/285 B

[58] Field of Search ..... 241/30, 199.12, 282.1, 241/282.2, 285 R, 285 A, 285 B, 193

[56] References Cited

U.S. PATENT DOCUMENTS

| | | | |
|---|---|---|---|
| 3,156,278 | 11/1964 | Otto | 241/282.2 |
| 3,312,261 | 4/1967 | Linschoter | 241/282.2 |
| 4,201,347 | 5/1980 | Elkin | 241/92 |
| 4,605,173 | 8/1986 | Edmonds | 241/199.12 |
| 4,621,774 | 11/1986 | Rahill | 241/84.3 X |
| 4,778,117 | 10/1988 | Karg | 241/282.2 X |

*Primary Examiner*—Timothy V. Eley

[57] ABSTRACT

The apparatus is provided with a processing drum having a rotatable comminuting blade driven by a shaft extending into the drum. An ashpan is rotatably positioned so as to move into and out of engagement with the drum for charging the drum with cremation remains for further comminution. During processing, the ashpan is rotated out of position. A pouring lid is fitted over the drum after processing, to permit the comminuted remains to be removed from the drum.

15 Claims, 2 Drawing Sheets

METHOD AND APPARATUS FOR COMMINUTING CREMATION REMAINS

FIELD OF THE INVENTION

The present invention relates to methods and equipment designed to process cremation remains.

DESCRIPTION OF THE PRIOR ART

Cremation is becoming more frequently used in the disposition of human remains. Various prior art techniques have been developed for the cremation of remains, which usually takes place in a crematory at extremely high temperatures. The cremation remains are then removed from the crematory, and may be later processed to reduce any fragments into fine particles. See, for example, U.S. Pat. No. 4,473,012 to Duran, which discloses a vacuum system for removal of cremation remains, and subsequent grinding of fragments into fine particles.

One of the difficulties with prior art arrangements for processing cremation remains is the use of perforated baskets, hoses and the like which increase the possibility that particles of the cremated human remains become lost in the processor itself. Another difficulty with prior art processors for cremation remains is the potentially dangerous hazards to the operator of the equipment, caused by the dust and particles that can be inhaled by the operator during processing.

SUMMARY OF THE INVENTION

The present invention is directed to a method and associated apparatus for comminuting cremation remains without the utilization of perforated baskets, hoses or similar equipment which tend to increase the risk that a high percentage of the cremation remains are not returned to the family of the deceased. In accordance with the method of the present invention, there is provided a unitary, cylindrical processing drum only open at one end, the drum having a drive shaft extending generally axially through a closed end opposite the open end. The drum has a pair of rotatable blades mounted on the shaft within the drum, each blade being swiveled along its length to permit recoil. After initial cremation, the remains are placed within the processing drum and the blades are rotated within the drum to comminute the remains into fine particles.

Further in accordance with the method of the present invention, a remains ashpan is provided which has a bottom with lateral dimensions greater than the open end of the drum, and having an opening dimensions to mate with the open end of the drum. The ashpan is formed of a non-ferrous material (i.e. stainless steel) so that the cremation remains may be poured into the ashpan without the danger of creating a blowback of dust or other fine particles. The remains may then be carefully poured from the bottom surface of the ashpan through the opening and into the processing drum. The nonferrous nature of the ashpan prevents the attraction of any ferrous metals which may be contained with the remains, which may be easily removed with a magnet.

Suitably, the ashpan is rotatably attached to the housing of the drive mechanism utilized to rotate the comminuting blades within the drum, so that the ashpan may be moved into and out of position over the open end of the drum. The ashpan preferably includes a cylindrical extension about the bottom opening which is dimensioned to extend into the opening of the one end of the drum when the ashpan is rotated into the drum-loading position.

THE DRAWING

DETAILED DESCRIPTION

Figure 6A:
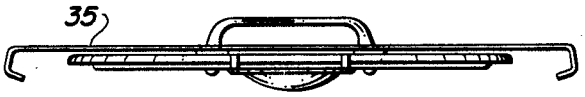
FIGS. 6A and 6B are side and bottom views, respectively, of a pouring lid for use with the processing drum after completion of the comminuting step.

The apparatus of the present invention is an assembly of conventional mechanical and electrical components, which are listed by corresponding reference numerals in the attached Appendix. The function of each component will be understood by those skilled in the art from a review of the drawings, the attached Appendix and the following description.

The apparatus of the prevent invention comprises the following major sub-assemblies: housing 1; motor 2; drive transfer mechanism including pulleys 9, 11 and belts 10; processing drum 21; blade shaft and blades 22, 24; and ashpan 27 with associated mounting means. Each of these major subassemblies will be described in greater detail next.

Figure 2:
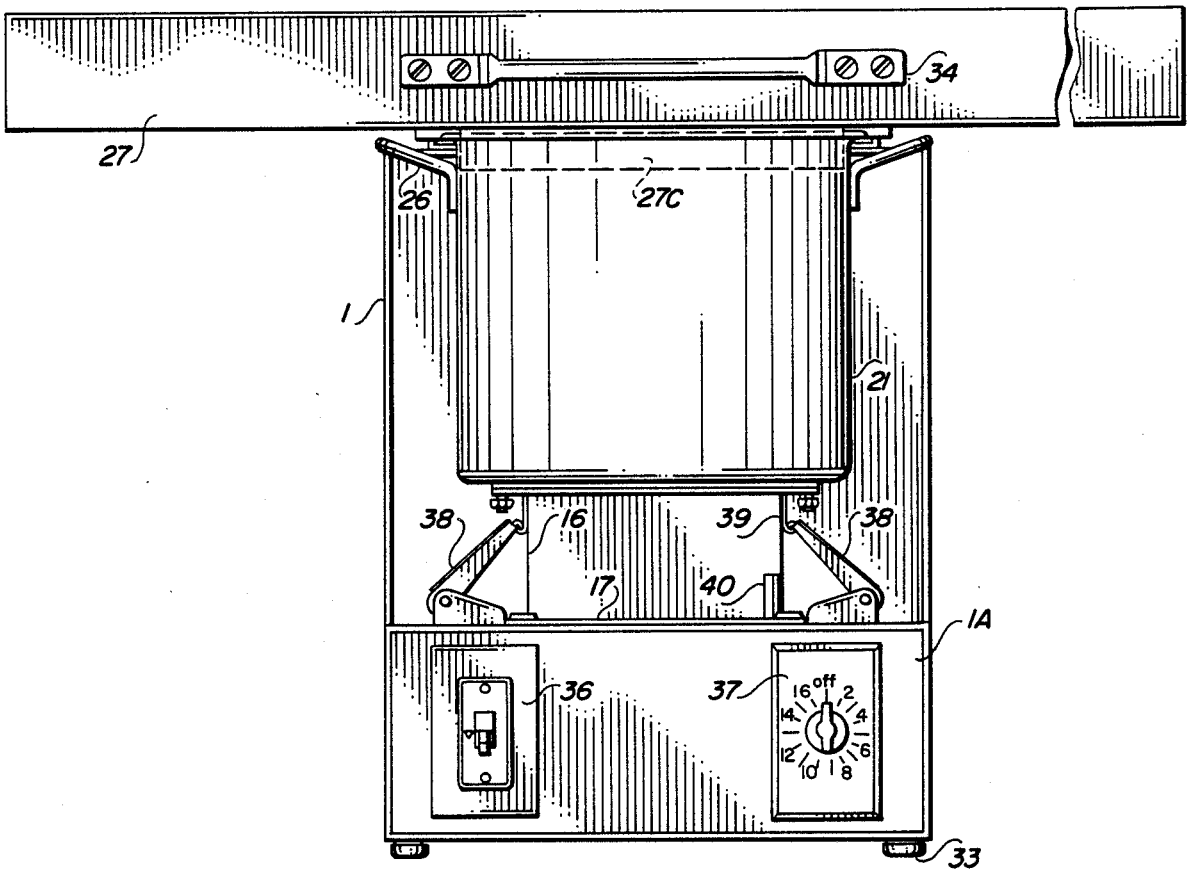
FIG. 2 is a front elevation of the apparatus shown in FIG. 1, and in which a portion of the apparatus which is hidden from view is illustrated by dotted lines.
Figure 3:
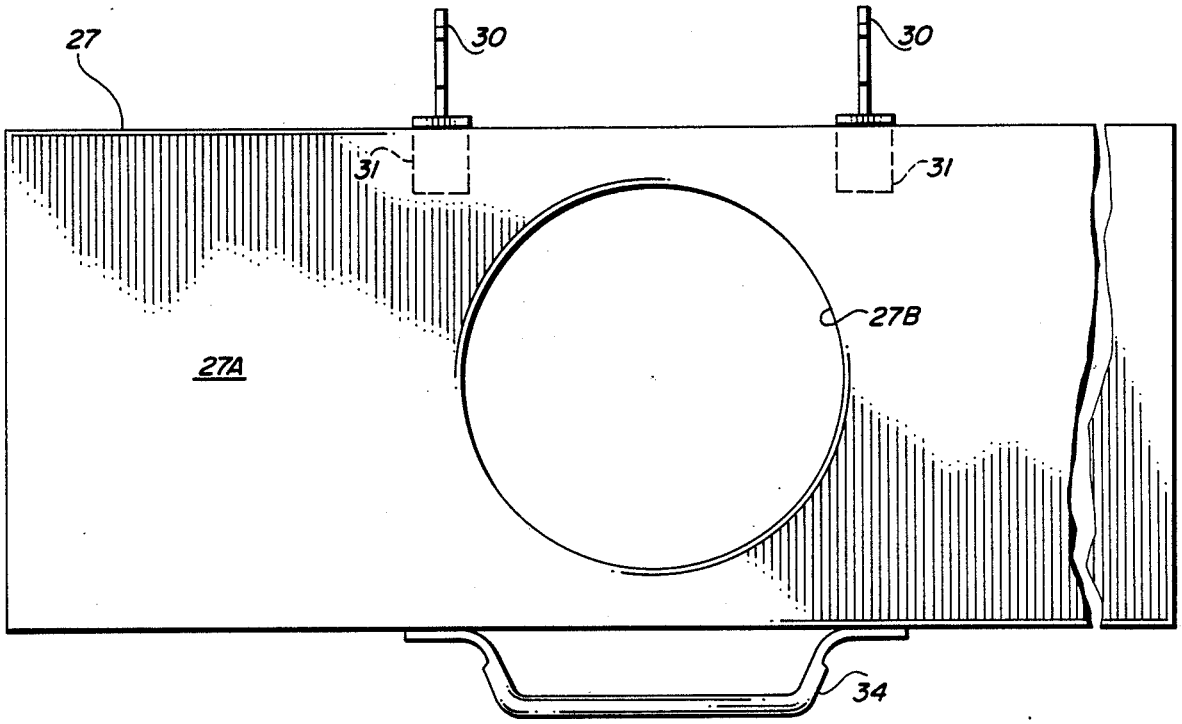

The housing 1 has a motor 2 mounted therein, the motor supported by an adjustment plate 3 so that tension of the belts 10 between pulleys 9 and may be properly adjusted. The housing 1 includes an extension 1A which supports the pulleys 11, drive shaft 12, bearing collar 13 and blade shaft 22, as well as the associated processing drum 21 and flanged housing 16. As shown in FIG. 2, the drum assembly 21 including the associated flanged housing 16 are held in place with latches 38 mounted to housing 1A. Upon release of the latches 38, the drum 21 and housing 16 may be easily removed from the housing 1A.

Figure 5:
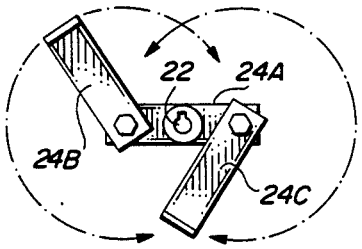
FIG. 5 is a top plan view of the rotating blades of the apparatus shown in FIGS. 1 and 2, and in which dotted arrows are utilized to illustrate the swiveling nature of the rotating blades.

The blade assembly 24 is mounted within the drum 21 onto blade shaft 22 for rotation with the operation of the motor 2 following energization from power switch 36 (FIG. 2). The length of time for processing may be controlled by timer 37. As is shown in FIG. 5, the blade assembly 24 includes a radial plate 24A and a pair of blades members 24B and 24C, each blade member being swivelled at a point spaced from the blade shaft 22. This blade construction permits each of the blade segments 24B and 24C to swivel, in order to allow some flexibility to recoil in order to eliminate any initial drag on the system and to further allow the brace to move out of the way if any large metal items are accidentally introduced into the processing drum 21.

The processing drum includes a covering lid 25 and side handles 26.

The ashpan assembly 27 includes a bottom surface 27A having both lengthwise and width dimensions which are substantially greater than the opening of the processing drum 21. The ashpan 27 further includes an opening 27B in the bottom 27A, the dimensions of the opening 27B corresponding with the opening of the drum 21, and further includes an extension 27C (FIG. 4) dimensioned to extend into the drum 21 when the ashpan 27 is rotated into the loading position over the drum. As is illustrated in FIGS. 1–4, the ashpan 27 is rotatably mounted to the housing 1 via hinges 30, welded angles 31, angled bracket 28 and shoulder bolt 29 (the bolt 29 serving as a pivot).

Figure 6B:
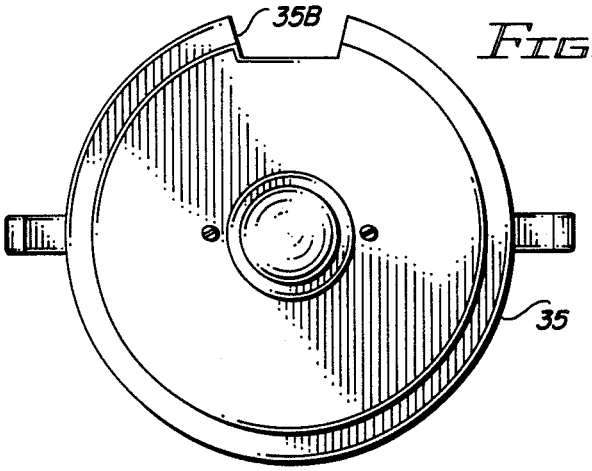
Figure 1:
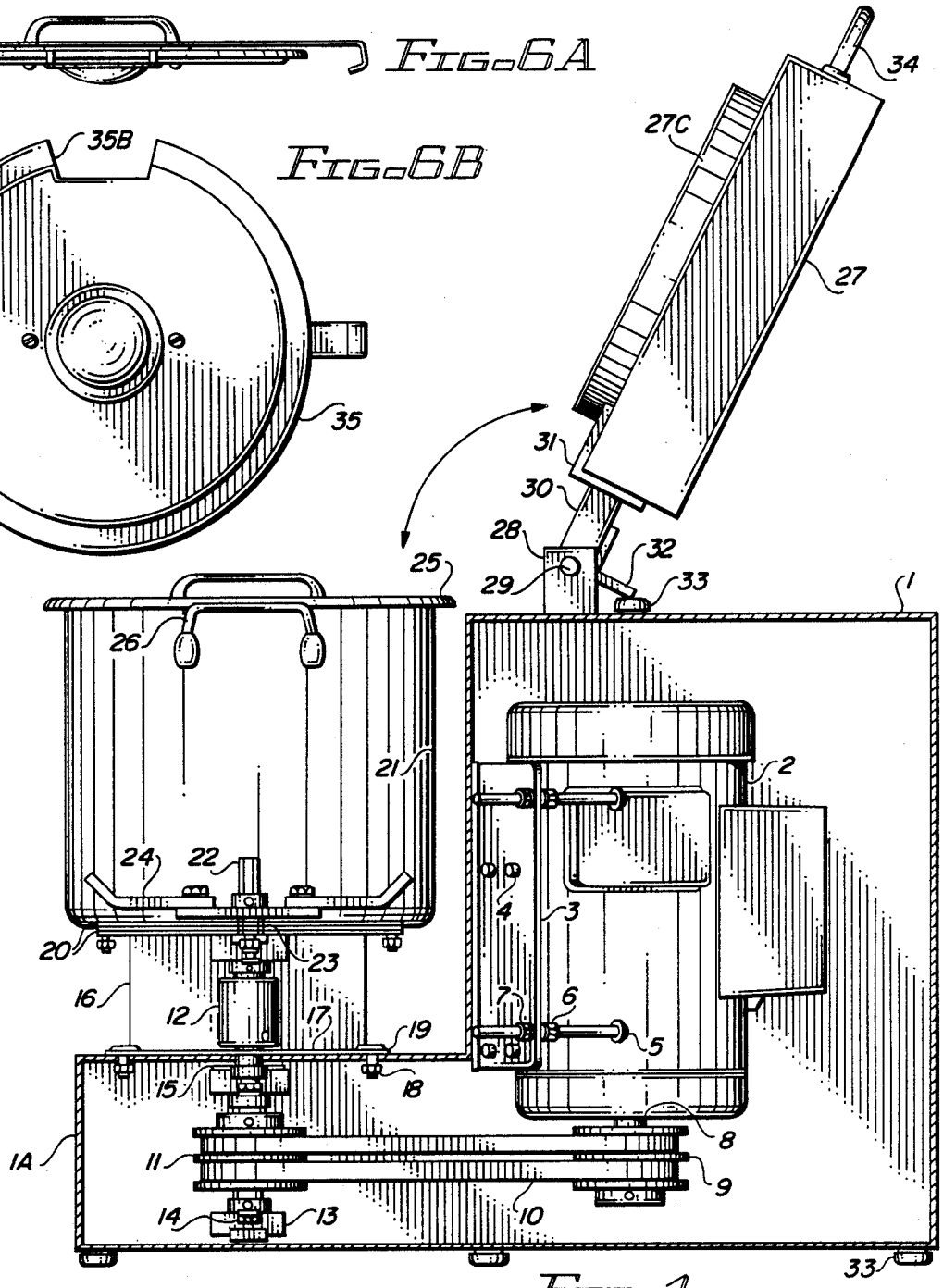
FIG. 1 is a side elevation, partially in crosssection, of apparatus in accordance with the present invention.
Figure 4:
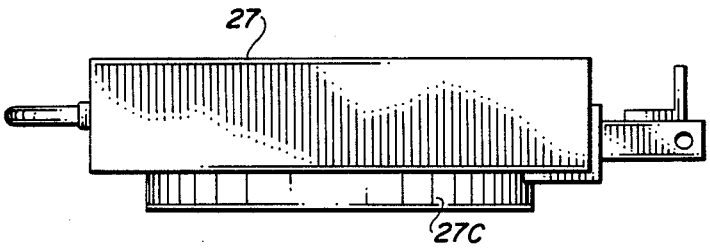
FIGS. 3 and 4 are top plan and side views of the ashpan portion of the apparatus shown in FIGS. 1 and 2.

As shown in FIG. 1, the processing drum 21 includes a lid 25 which utilizes a conventional gasket to provide an appropriate seal during operation of the comminuting sequence. After the processing has taken place, the processing lid 25 is removed, and a pouring lid 35 shown in FIGS. 6A and 6B is fitted over the processing drum 21 in order to permit the comminuted remains to be poured from the drum. Noting FIGS. 6A and 6B, the pouring lid 35 includes a piece of metal stock 35A which extends across the lid and is bent at either end to grip the flanged edge of the open end of the processing drum 21. The pouring lid 35 further includes an indented opening 35B along its periphery, which permits the comminuted remains to be poured from the processing drum 21 through the restriction of the opening.

From the above description of the apparatus of the present invention, it will be understood that the cremated remains are initially placed into the ashpan bottom 27A, while the ashpan 27 is in the loading position over the opening of the drum 21 (and with lid 25 removed). The cremated remains may be subjected to a magnet (as described above) and are then gently moved across the bottom of the ashpan 27, through the opening 27B and into the processing drum 21. The ashpan 27 is then rotated into the position shown in FIG. 1, the processing lid 25 is placed on the processing drum 21, and the motor 2 is energized by a switch 36 in order to rotate blade shaft 22 and blades 24. After a period of comminution, the motor is deenergized, and the processing lid 25 removed and the pouring lid 35 is placed over the open end of the processing drum 21. The latches 38 are released, the pouring drum 21 and associated housing 16 are lifted from the housing extension 1A and the remains poured through opening 35B into a suitable urn.

It will be appreciated by those skilled in the art that the apparatus and method described above provide a simple, low-cost means for effectively comminuting cremated human remains in a manner which avoids the above-described problems associated with prior art cremation remains processing techniques.

APPENDIX

1. Housing
2. Motor
3. Belt Adjustment Plate
4. Motor Mount Screw
5. Belt Adjustment Screw
6. Nut, Belt Adjustment Screw
7. Washer, Belt Adjustment Screw
8. Motor Shaft
9. Double Pulley
10. Belt
11. Double Pulley
12. Drive Shaft
13. Bearing Collar
14. Screw w/Lock Nut
15. Washer
16. Flanged Housing
17. Hard Plastic Plate
18. Screw w/Lock Nut
19. Finished Washer
20. Disc
21. Drum
22. Blade Shaft
23. Brass Bushing
24. Blade Assembly
25. Processing Lid
26. Drum Handle
27. Ashpan
28. Angle
29. Shoulder Bolt
30. Hinge
31. Angle
32. Angle
33. Rubber Foot
34. Ashpan handle
35. Pouring Lid
36. Power On/Off Switch
37. Processing Timer, Minutes
38. Latch
39. Latch Hook
40. "L" Stop

What is claimed is:

1. A method for comminuting cremation remains comprising the steps of:
   - providing a unitary processing drum having a comminuting blade therein;
   - initially cremating the remains and then placing the cremated remains within the processing drum;
   - providing a remains ashpan having an opening with dimensions greater than the processing drum and fitted over the drum opening;
   - placing the remains in the ashpan after the initial cremation;
   - transferring the remains into the drum from the ashpan;
   - rotating the comminuting blade within the drum to comminute the remains; and then
   - removing the remains from the drum.

2. The method recited in claim 2 further comprising the steps of:
   - mounting the mated ashpan and drum on a drive assembly;
   - rotating the ashpan out of engagement with the drum after the step of transferring the remains into the drum; and
   - placing a lid over the processing drum during the comminuting step.

3. The method recited in claim 1 further comprising the step of driving the rotating blade with a shaft extending through the drum.

4. A method for comminuting cremation remains, comprising the steps of:
   - providing a unitary processing drum having a comminuting blade therein;
   - initially cremating the remains and then placing the cremated remains within the processing drum;
   - rotating the comminuting blade within the drum to comminute the remains;
   - removing the remains from the drum; and
   - swiveling the blade while rotating.

5. A method for comminuting cremation remains comprising the steps of:
   - providing a unitary processing drum having a comminuting blade therein;

providing a remains ashpan having an opening with dimensions greater than the opening of the processing drum and fitted over the drum opening;

initially cremating the remains and then placing the cremation remains in the ashpan;

transferring the remains into the drum from the ashpan;

rotating the ashpan away from the drum and covering the opening of the drum;

rotating the comminuting blade within the drum to comminute the remains; and then removing the remains from the drum.

6. Apparatus for comminuting cremation remains comprising:

a remains ashpan;

a unitary processing drum for receiving cremation remains from the ashpan;

means for fixing the ashpan with the drum for permitting a transfer of cremation remains from the ashpan to the drum;

a rotatable comminuting blade within the processing drum; and means for rotating the blade within the drum about an axis of rotation for comminuting the cremation remains.

7. The apparatus recited in claim 6 further comprising means permitting the swiveling of the blade during rotation, so that the blade may recoil to eliminate drag of large objects contained within the cremation remains.

8. The apparatus recited in claim 6 wherein the processing drum comprises an opening dimensioned to mate with the ashpan, whereby cremation remains may be placed in the drum without inadvertent spilling of remains.

9. Apparatus for comminuting cremation remains comprising:

a cylindrical processing drum only open at one end, the drum having a drive shaft extending generally axially through a closed end opposite the open end;

a pair of rotatable blades mounted on the shaft within the drum, each blade swiveled along its length to permit recoil;

means external to the drum for rotating the shaft to thereby comminute cremation remains within the drum;

a remains ashpan having a bottom with lateral dimensions greater than the open end of the drum, the bottom having an opening dimensioned to mate with the open end of the drum; and means rotating the ashpan in and out of position over the open end of the drum.

10. The apparatus recited in claim 9 wherein the ashpan further comprises a cylindrical extension about the bottom opening and dimensioned to extend into the opening in the one end of the drum when the ashpan is rotated into position over the drum.

11. The apparatus recited in claim 9 further comprising a housing for the rotating means, and wherein the ashpan rotating means is pivotably supported on the housing.

12. The apparatus recited in claim 9 further comprising:

a processing lid dimensioned to fit over and completely close the open end of the drum during processing; and a pouring lid dimensioned to fit over the open end of the drum after processing, the pouring lid having a restricted opening along its periphery for permitting the removal of cremation remains in the drum after processing.

13. A method for cremating and comminuting remains, comprising the steps of:

providing a processing drum having comminuting means therein;

providing an ash container dimensioned to fit with the processing drum;

cremating the remains and then placing the remains in the ash container;

fitting the ash container to the processing drum;

passing the cremated remains from the ash container to the processing drum;

comminuting the cremated remains within the drum; and thereafter removing the remains from the drum.

14. The method recited in claim 13 further comprising the step of rotating at least the ash container when fitted with the processing drum.

15. A method for comminuting cremation remains, comprising the steps of:

providing a unitary processing drum having plural comminuting blades and being provided with means for a recoil of the blades when the blades come in contact with large objects in the comminuting drum in order to eliminate drag;

initially cremating the remains and then placing the cremated remains within the processing drum;

rotating the comminuting blades within the drum to comminute the remains, while permitting the recoil of the blades when in contact with large objects; and then removing the remains from the drum.

* * * * *